US005425455A

United States Patent [19]

Miller et al.

[11] Patent Number: 5,425,455

[45] Date of Patent: Jun. 20, 1995

[54] FOLDING LAP TRAY

[76] Inventors: Bob Miller, 3581 Klaus Dr., San Jose, Calif. 95121; Brett Setterlund, 1090 Danbury Dr., San Jose, Calif. 95129

[21] Appl. No.: 280,061

[22] Filed: Jul. 25, 1994

[51] Int. Cl.[6] ..... B65D 1/34; B65D 6/04

[52] U.S. Cl. ..... 206/562; 229/904

[58] Field of Search ..... 206/562, 564, 557; 229/904

[56] References Cited

U.S. PATENT DOCUMENTS 2,466,636 4/1949 Bruckner et al. ..... 229/904 X
2,647,678 8/1953 Olson ..... 229/904 X
2,808,191 10/1957 Cramer ..... 229/904 X
3,430,650 3/1969 Goings ..... 229/904 X

*Primary Examiner*—Jacob K. Ackun
*Attorney, Agent, or Firm*—Keith Kline

[57] ABSTRACT

A lap tray that is folded from a corrugated cardboard blank. The tray portion can be permanently bonded in place after it has been folded from the blank. The tray has a central support means, which the user can grip with his legs. The tray's upper surface includes a receptacle for a drink container, and perimeter boundaries so that objects cannot easily slide off of the tray. The tray can be folded flat for easy storage and transport.

8 Claims, 2 Drawing Sheets

FOLDING LAP TRAY

FIELD OF THE INVENTION

The present invention relates generally to lap trays, and more particularly is a folding lap tray designed to be used at a sporting event.

BACKGROUND OF THE INVENTION

A common predicament with which many a sports fan has contended is what to do with the things he wants to have close at hand, e.g. refreshments, scorecards, etc. This problem is not unique to sporting events, but rather is common to everyone who has juggled multiple food items and drinks. The problem is magnified at sporting events due to the limited space available, and the large number of items that can be useful.

There are many devices in the prior art which relate to the problem of holding or carrying food items. The device probably most often encountered is one such as the "PAPERBOARD SERVING TRAY" of Walter L. Peiker, U.S. Pat. No. 2,512,963. This device is that found at fast food restaurants, and includes receptacles for liquid containers, and a central depressed area for food items. While this device does alleviate the problem of carrying multiple food items, it makes no provision to aid the user when he sits down.

An inventor who recognized that people often eat or transport food in their cars was H. E. Goings, who holds two patents on a "CAR SEAT TRAY", U.S. Pat. Nos. 3,326,445 and 3,326,445. These devices are designed to sit on a vacant car seat, and include receptacle for drinks and a space for food. These devices make no provision for being held on a user's lap.

Devices that were designed to serve as lap trays are the "LAP TRAY" of C. A. Cramer, U.S. Pat. No. 2,808,191, and the "FOLDABLE LAP TRAY" of John J. Hood, Jr., U.S. Pat. No. 5,127,339. The Cramer device is in the form of an angled box, with multiple areas on the top surface that can be punched out to hold various items. The device is angled on the assumption that the upper surface of a user's legs would be angled downward when sitting. The angled lower surface would therefore provide a flat upper surface. Unfortunately, that angle would depend on the length of each user's legs and the surface on which he was sitting. In addition, there is no provision to stabilize the device.

The Hood device is also in box form, but is directed to a situation in which the user wraps the lower surface of the device under his legs to stabilize the tray. The user ends up with his legs inside the tray to keep it in place. While this would certainly stabilize the tray, it would require a good deal of space to deploy, and would greatly restrict the mobility of the user.

There are also devices in the art which do provide legs for stability, while retaining the folding aspect of the tray. Two such inventions are the "FOLDING TABLE" of Stone, U.S. Pat. No. 2,240,024, and the "ONE-PIECE COLLAPSIBLE TABLE" of Lassaine, et al., U.S. Pat. No. 3,348,345. These devices provide support legs at the periphery of the table, while retaining the folding structure of the devices described above.

None of these prior art devices disclose a lap tray that is foldable, so that it can be constructed from cardboard, and yet makes provision for the fact that a tray on a user's lap is inherently unstable.

There are devices in the prior art which address these shortcomings, such as the "LEG SUPPORTED TRAY" of Jenkins, U.S. Pat. No. 5,176,274, which has a tray portion in addition to elements which are to be propped on the user's legs. However, this device is constructed from rigid material, which will eliminate any folding aspect of the device, and will greatly increase production costs as well. By creating a rigid device, transport and storage is also made more difficult.

OBJECTS, SUMMARY, AND ADVANTAGES OF THE INVENTION

Accordingly, it is an object of the present invention to provide a tray that is foldable from a cardboard blank, and which has means whereby the user can stabilize the device in his lap.

It is a further object of the present invention to provide a lap tray which provides a receptacle for a drink, and which also has a flat surface usable as a writing area.

It is another object of the present invention to provide a device that can be made from corrugated cardboard, leading to simple and inexpensive construction.

In summary, the present invention is a lap tray that is folded from a corrugated cardboard blank. The tray can be glued, taped, or clipped in place after it has been folded from the blank. Ordinarily, the elements forming the tray surface itself will be permanently bonded.

The tray has a central support means, which the user can grip with his legs. The tray's upper surface includes a receptacle for a drink container, and can have perimeter boundaries so that objects cannot easily slide off of the tray.

An advantage of the present invention is that it can be gripped by the user's legs, thereby reducing the chances of the tray shifting position and spilling its contents.

Another advantage of the present invention is that it can be easily and inexpensively constructed from corrugated cardboard.

Still another advantage of the present invention is that it can be folded into a flat conformation, making for easy storage and transport.

Another advantage of the present invention is that due to its unique construction, a double layer of cardboard is created on the tray portion for additional strength.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 2:
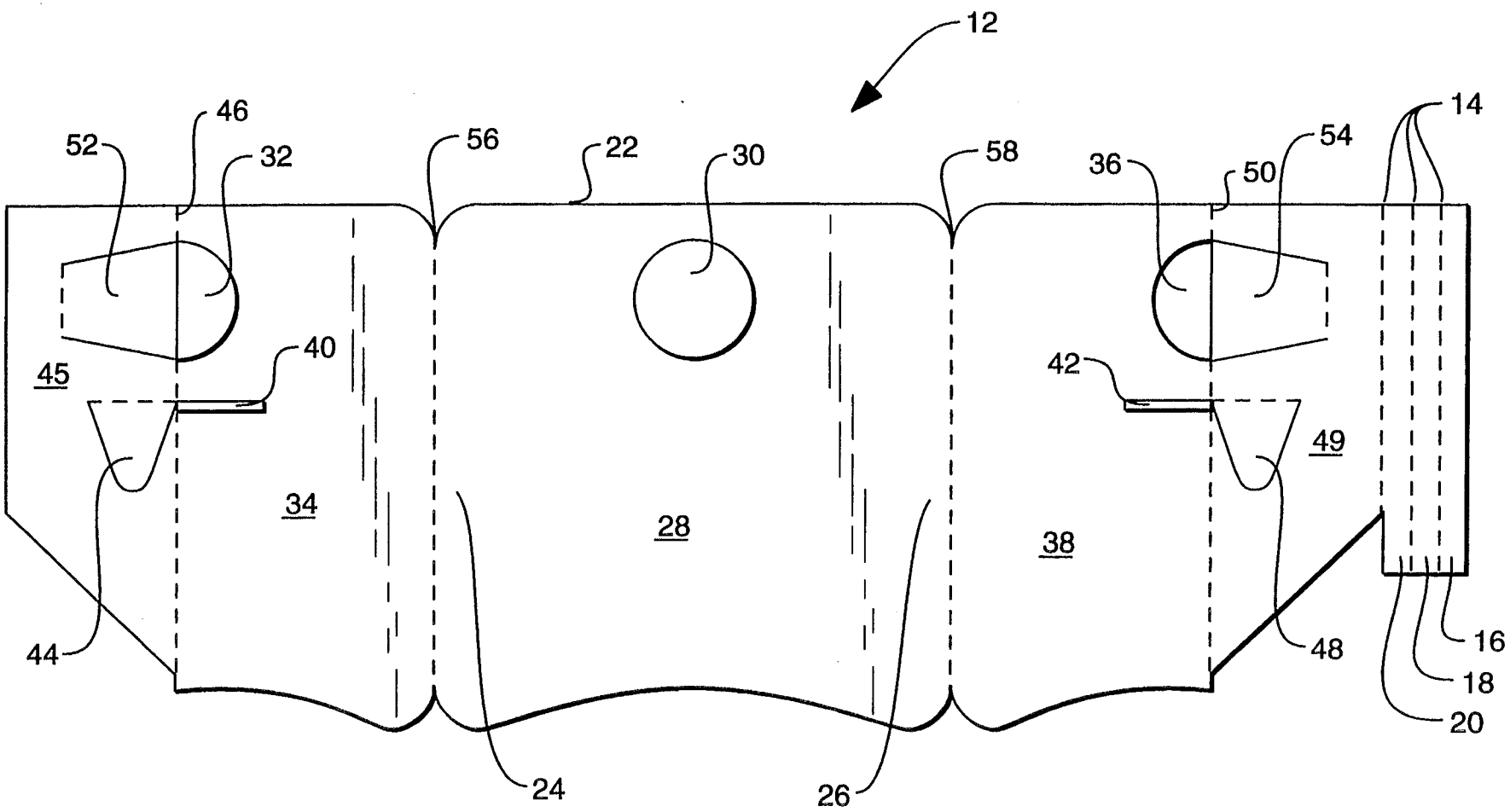
FIG. 2 is a top view of the cardboard blank used to construct the folding lap tray of the present invention.

The present invention is a folding lap tray 10. Construction of the lap tray 10 can most easily be understood by reference to FIG. 2. FIG. 2 shows the cardboard blank 12 used to construct the tray 10. It should be noted that the cutting of the blank 12 from a cardboard sheet, and all necessary cutting and scoring in the blank, is performed in a single die-cut operation on a standard sheet of corrugated cardboard.

The die cut is performed so that the blank 12 is scored along lines 14 so as to form three removable (by hand) perimeter boundary strips—a first strip 16, a second strip 18, and a third strip 20. The strips 16, 18 & 20 may be affixed by gluing or taping during assembly to a front 22, left 24, and right 26 side respectively of a central panel 28 of the blank 12.

In order to form the opening for a cup holder, a circular opening 30 is cut into the central panel 28, as well as a left semicircular opening 32 in a left inner panel 34 of the blank 12, and a right semicircular opening 36 in a right inner panel 38 of the blank 12. Additionally, a left tab slot 40 is cut as shown in the left inner panel 34, and a right tab slot 42 is cut in the right inner panel 38.

To form support means for the tray 10, folding support tabs are provided in the side panels. A left support tab 44 is cut into a left outer panel 45 just outside a left outer fold line 46. A right support tab 48 is cut into a right outer panel 49 at a corresponding location outside a right outer fold line 50.

To provide a base for a cup or other type of liquid container, cup holder tabs are also cut into the side panels. A left cup holder base tab 52 is cut above the left support tab 44, and a right cup holder base tab 54 is cut above the right support tab 48.

Assembly of the folding lap tray 10 is as follows: The three strips 16, 18 & 20 are first removed from the main body of the blank 12, and are then separated from each other. If the raised perimeter is desired, the strips 16, 18 & 20 are then affixed to the front 22, left 24, and right 26 sides respectively of the central panel 28. The strips 16, 18 & 20 thus form a raised boundary (see FIG. 1) on the upper surface of the tray to prevent items from slipping and/or rolling off of the tray. (The affixing of the strips can be performed after the tray is completely assembled if desired.)

Next, the left and right outer panels 45 & 49 are folded inward along outer fold lines 46 & 50, past a 90° angle with the inner panels 34 & 38. Then, the left and right inner panels 34 & 38 are folded downward along a left inner fold line 56 and a right inner fold line 58 respectively, until the left and right inner panels 34 & 38 lie flat against the central panel 28. The left and right semicircular openings 32 & 36 align with the circular opening 30 to form a cup holder 60.

At this point the left and right inner panels 34 & 38 can be permanently affixed to the center panel 28. By folding the inner panels onto the center panel, a tray portion 62 with a double layer of cardboard is formed. This gives the tray much greater strength and stability than many cardboard tray devices.

The left and right outer panels 45 & 49 are next locked into place to form the legs 64 of the tray. This is accomplished by folding out the support tabs 44 & 48, and inserting them into tab slots 40 & 42 respectively. This configuration provides for a central base for the tray. Moreover, it provides a convenient means for the user to grip the tray with his thighs. The user can thus ensure that the tray remains on his lap.

Finally, the cup holder base tabs 52 & 54 are folded across each other to form a cup holder base 66. A cup inserted into the cup holder 60 will rest on the base 66 so that it is stable and not likely to be spilled.

Figure 1:
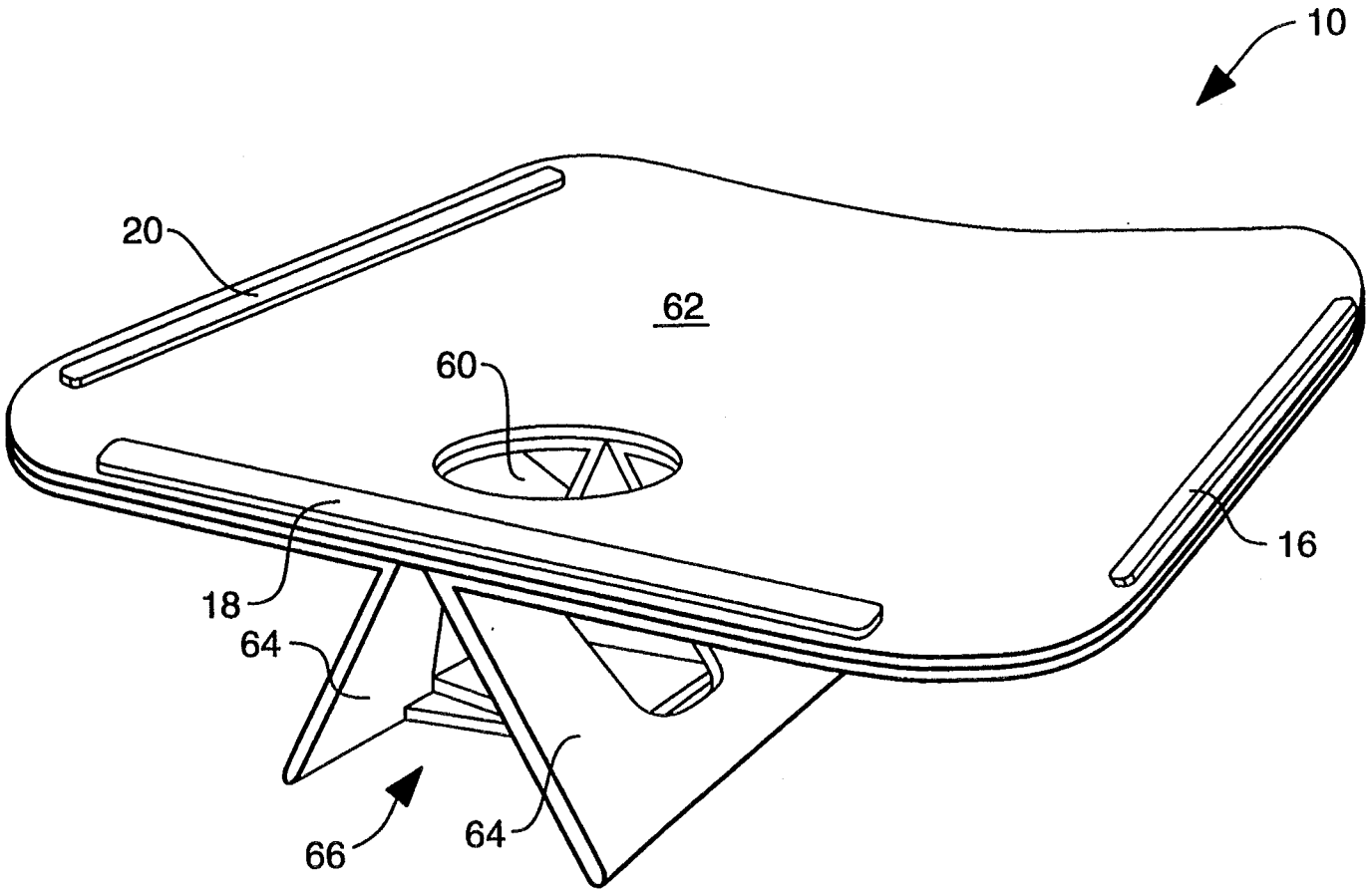
FIG. 1 is a perspective view of the folding lap tray of the present invention.

Following these steps, the folding lap tray will be in the conformation illustrated in FIG. 1. The legs 64 form an inverted V-shaped base which the user can grip with his thighs. A rear side of the tray's upper surface is contoured to conform to the shape of the users body. The upper surface of the tray portion 62 forms a table which the user can use for his food, for writing on his scorecard, or for any other purpose a table serves.

The tray 10 can be folded into a flat piece by removing the support tabs 44 & 48 from the slots 40 & 42, and folding the tabs flat against the outer panels 34 & 38. The cup holder base tabs 52 & 54 are also folded back into the outer panels 34 & 38, leaving the tray completely flat for easy storage and transport.

It is envisioned that the tray will be utilized to bear various team logos or other advertising. The flat upper surface is particularly well suited to this purpose.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A lap tray device comprising:

a tray portion including a cup holder, said tray portion being generally rectangular in shape with rounded corners, a rear side of said tray portion being contoured to the shape of the user's body, and support legs integral to the lap tray and positioned in the longitudinal center of the tray portion, said support legs extending outward in an inverted V-shape from their point of origination at an underside of said tray portion, each leg being held in position by a support tab received in a slot in the underside of said tray portion, and by a cup holder base tab which overlaps a cup holder base tab from the opposing support leg;

said tray portion and support legs being formed from a single cardboard blank, said cardboard blank being a die-cut piece of cardboard.

2. The lap tray device of claim 1 wherein:

the tray portion comprises a double layer of cardboard.

3. The lap tray device of claim 1 wherein:

said tray portion includes retaining strips on front, left and right sides of an upper surface thereof, the strips forming a boundary around said upper surface.

4. The lap tray device of claim 1 wherein:

said support tabs are integral to said cardboard blank.

5. The lap tray device of claim 1 wherein:

said cup holder includes a base formed by said cup holder base tabs, said cup holder base tabs being integral to said cardboard blank.

6. The lap tray device of claim 1 wherein:

the device is folded flat for storage and transport.

7. A lap tray device comprising:

a tray portion including a cup holder, said tray portion being generally rectangular in shape with rounded corners, and support legs integral to the lap tray and positioned in the longitudinal center of the tray portion, said support legs extending outward in an inverted V-shape from their point of origination at an underside of said tray portion, each leg being held in position by a support tab received in a slot in the underside of said tray portion, and by a cup holder base tab which overlaps a cup holder base tab from the opposing support leg;

said tray portion and support legs being formed from a single cardboard blank, said cardboard blank being a die-cut piece of cardboard, said cardboard blank being folded such that the tray portion comprises a double layer of cardboard;

a rear side of said tray portion being contoured to the shape of the user's body, said tray portion further including retaining strips on front, left and right sides of an upper surface thereof, the strips forming a boundary around said upper surface, said cup holder in said tray portion including a base formed by said cup holder base tabs, the cup holder base tabs being integral to said cardboard blank, said support legs being fixed in position by support tabs integral to said cardboard blank.

8. The lap tray device of claim 7 wherein:

the device is folded flat for storage and transport.

* * * * *